US006708819B1

(12) United States Patent
Lee

(10) Patent No.: US 6,708,819 B1
(45) Date of Patent: Mar. 23, 2004

(54) CLOSET STORAGE DEVICE

(76) Inventor: Siew S. Lee, 103 Lensbury Way, S Thamesmead London (GB), SE2 9TA ( * ) Notice: Subject to any disclaimer, the term of this patent is extended or adjusted under 35 U.S.C. 154(b) by 88 days.

(21) Appl. No.: 10/103,939

(22) Filed: Mar. 22, 2002

(51) Int. Cl.[7] ..... B65D 85/18
(52) U.S. Cl. ..... 206/287.1; 206/280; 190/13 R
(58) Field of Search ..... 206/287.1, 280, 206/284, 285, 286–300; 190/13 R; 383/22–24; 160/108, 109, 121; 150/111, 112, 123

(56) References Cited

U.S. PATENT DOCUMENTS

| | | | | | |
|---|---|---|---|---|---|
| 1,866,241 | A | * | 7/1932 | Vineberg | 206/287 |
| D115,502 | S | | 7/1939 | Kohl | |
| 2,815,785 | A | | 12/1957 | Vail | |
| 3,670,947 | A | | 6/1972 | Tangredi et al. | |
| 3,687,277 | A | * | 8/1972 | Spencer et al. | 206/284 |
| 3,869,034 | A | * | 3/1975 | Thornton, Jr. | 190/13 R |
| 3,889,869 | A | * | 6/1975 | Oggesen | 383/25 |
| 4,193,482 | A | * | 3/1980 | Koff | 139/114 |
| 4,590,610 | A | | 5/1986 | Rhyne | |
| 4,932,506 | A | * | 6/1990 | Kim | 190/111 |
| D312,899 | S | * | 12/1990 | Faulkner | D32/8 |
| 4,991,245 | A | * | 2/1991 | Franco | 5/419 |
| 5,050,998 | A | * | 9/1991 | Wachtel | 383/6 |
| 5,090,559 | A | | 2/1992 | Gendreau | |
| 5,143,214 | A | * | 9/1992 | Freelander et al. | 206/287 |
| 5,370,230 | A | | 12/1994 | Cox | |
| 5,503,476 | A | * | 4/1996 | Hamdan | 383/9 |
| 2001/0027834 | A1 | * | 10/2001 | Shouthwick | |

FOREIGN PATENT DOCUMENTS

| | | | | |
|---|---|---|---|---|
| GB | 2118526 | * | 11/1983 | 206/287 |

* cited by examiner

*Primary Examiner*—Stephen K. Cronin
*Assistant Examiner*—Lien Ngo

(57) ABSTRACT

A the closet storage device for storing and retrieving articles within a closet. The the closet storage device includes a container member having a perimeter wall. The perimeter wall defines an interior space. The container member has an open top whereby the open top is designed for permitting articles to be inserted into the interior space of the container member. A hanger member has a bottom portion. The bottom portion is coupled to the container member whereby the container member is suspended below the hanger member. The hanger member is designed for selectively engaging a closet rod for suspending the container member in the closet.

9 Claims, 2 Drawing Sheets

CLOSET STORAGE DEVICE

BACKGROUND OF THE INVENTION

1. Field of the Invention

The present invention relates to reusable garment bags and more particularly pertains to a new the closet storage device for storing and retrieving articles within a closet.

2. Description of the Prior Art

The use of reusable garment bags is known in the prior art. U.S. Pat. No. 5,090,559 describes a device for providing a dry cleaning bag that is reusable. Another type of reusable garment bag is U.S. Pat. No. 2,815,785 having a bag member engaging a hanger for suspending the bag member in a closet. U.S. Pat. No. 5,370,230 has a container that engages a hanger for storing clothes within a closet. U.S. Pat. No. 3,670,947 has a hanger bag with a hook portion to engage a closet rod for storing articles within the hanger bag in a closet. U.S. Pat. No. 4,590,610 has a display package with a hanger for hanging from a support member to display the articles positioned in the display package. U.S. Pat. No. Des. 115,502 shows a transparent mothproof garment container.

While these devices fulfill their respective, particular objectives and requirements, the need remains for a device that has certain improved features allowing a hook stick to easily retrieve the hanger member and container member from the closet rod without the hanger member slipping off of the hook stick.

SUMMARY OF THE INVENTION

The present invention meets the needs presented above by providing a loop portion forming an apex that defines a receiving space. The receiving space receives the end of the hook stick and the apex inhibits the hanger member from shifting with respect to the hook stick.

Still yet another object of the present invention is to provide a new the closet storage device that allows articles to be stored on closet rods and retrieved by store personnel without the need for the personnel to use climbing devices, such as a ladder.

Even still another object of the present invention is to provide a new the closet storage device that facilitates retrieval of articles for sale without the need to stand on climbing devices, such as ladders, and search through boxes to find an article.

To this end, the present invention generally comprises a container member having a perimeter wall. The perimeter wall defines an interior space. The container member has an open top whereby the open top is designed for permitting articles to be inserted into the interior space of the container member. A hanger member has a bottom portion. The bottom portion is coupled to the container member whereby the container member is suspended below the hanger member. The hanger member is designed for selectively engaging a closet rod for suspending the container member in the closet.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
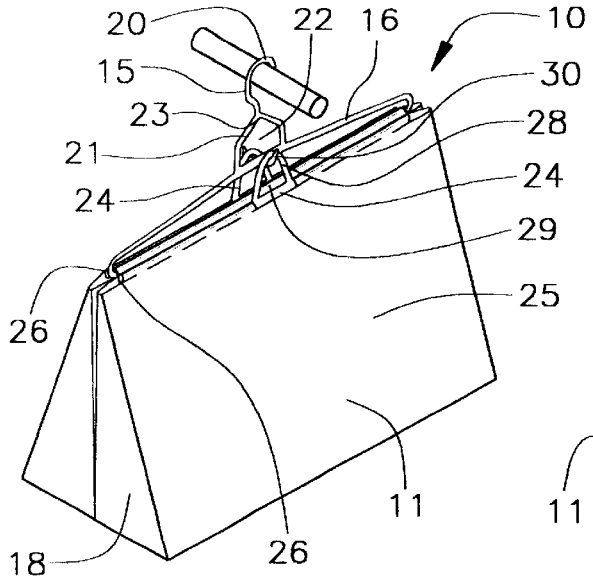
FIG. 1 is a perspective view of a new the closet storage device according to the present invention in use on a closet rod.
Figure 2:
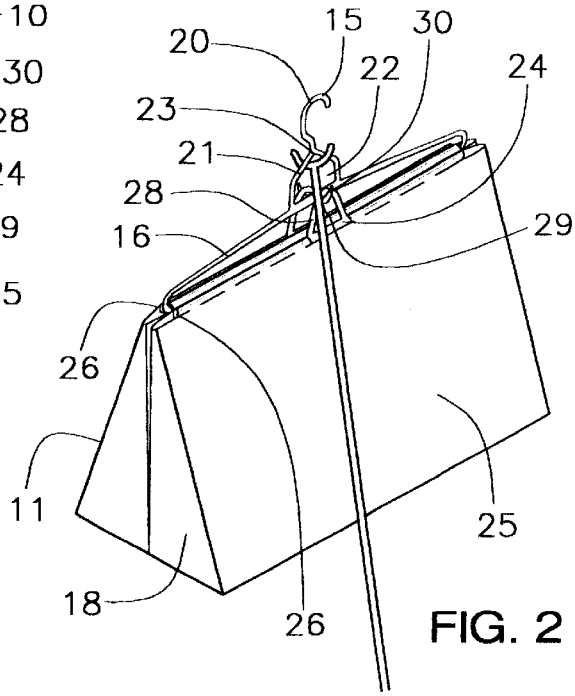
FIG. 2 is a perspective view of the present invention in use on a hook stick.
Figure 3:
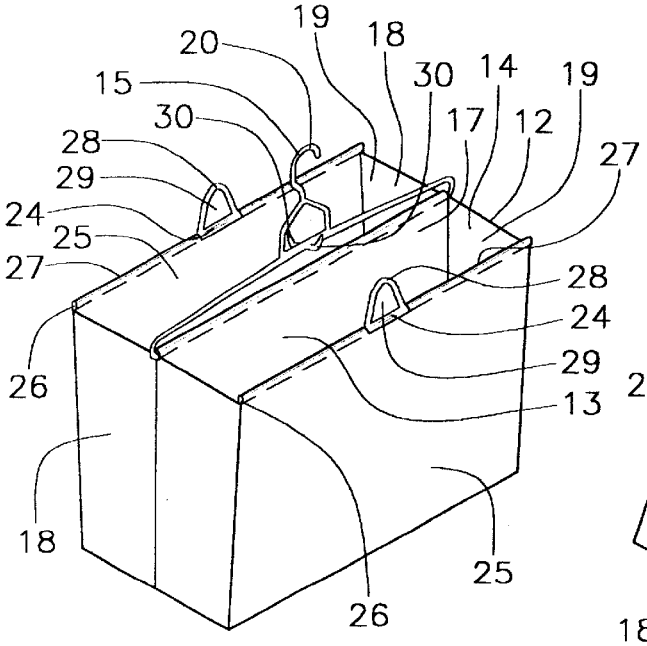
FIG. 3 is a perspective view of the present invention in an open state.
Figure 4:
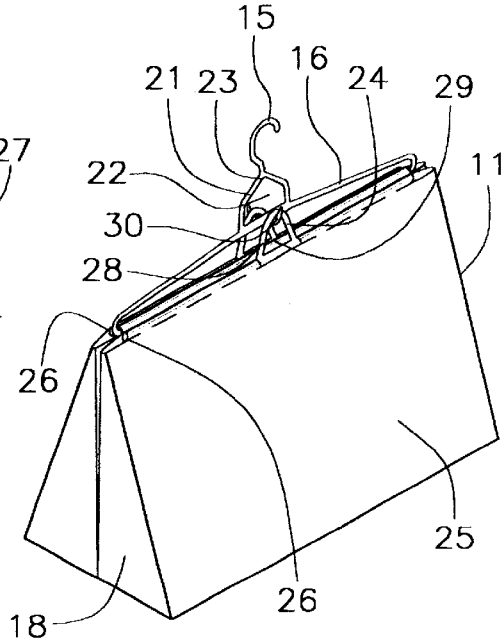
FIG. 4 is a perspective view of the present invention in a closed state.
Figure 5:
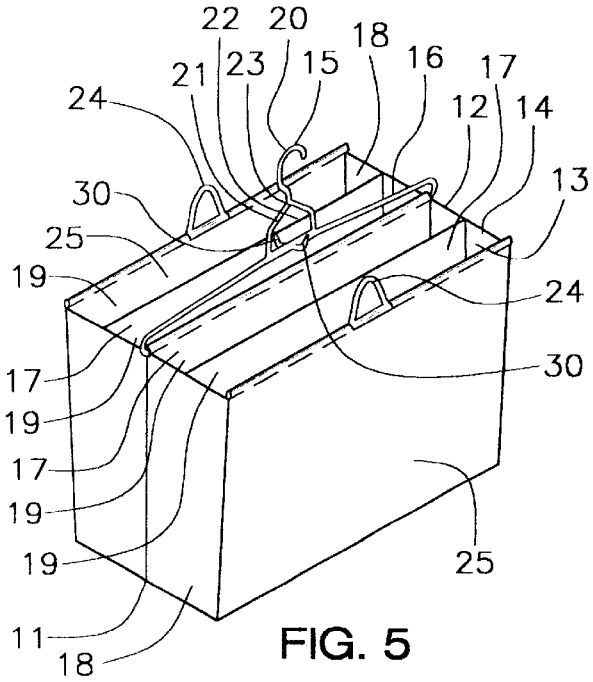
FIG. 5 is a perspective view of an embodiment of the present invention showing a plurality of dividing walls.

With reference now to the drawings, and in particular to FIGS. 1 through 9 thereof, a new the closet storage device embodying the principles and concepts of the present invention and generally designated by the reference numeral 10 will be described.

As best illustrated in FIGS. 1 through 9, the the closet storage device 10 generally comprises a container member 11 having a perimeter wall 12. The perimeter wall 12 defines an interior space 13. The container member 11 has an open top 14 whereby the open top 14 is designed for permitting articles, such as clothing, to be inserted into the interior space 13 of the container member 11.

A hanger member 15 has a bottom portion 16. The bottom portion 16 is coupled to the container member 11 whereby the container member 11 is suspended below the hanger member 11. The hanger member 15 is designed for selectively engaging a closet rod for suspending the container member 11 in the closet.

The container member 11 has at least one dividing wall 17. The dividing wall 17 extends between a pair of side walls 18 of the perimeter wall 12 of the container member 11. The dividing wall 17 is positioned in the interior space 13 whereby the dividing wall 17 is for dividing the interior space 13 into a plurality of compartments 19.

The dividing wall 17 is coupled to the bottom portion 16 of the hanger member 15. The dividing wall 17 is designed for dispersing weight from the container member 11 and the articles in the interior space 13 of the container member 11 along a portion of a length of the bottom portion 16 of the hanger member 15.

The hanger member 15 has a hook portion 20. The hook portion 20 upwardly extends from the bottom portion 16 of the hanger member 15 opposite the container member 11. The hook portion 20 is designed for selectively engaging the closet rod of the closet for suspending the container member 11 in the closet when the hook portion 20 of the hanger member 15 engages the closet rod.

The hanger member 15 has a loop portion 21 The loop portion 21 is positioned between the bottom portion 16 and the hook portion 20 of the hanger member 15. The loop portion 21 defines a receiving space 22 between the loop portion 21 and the bottom portion 16 of the hanger member 15 whereby the receiving space 22 is designed for receiving an end of a hook stick for disengaging the hanger member 15 from the closet rod. The loop portion 21 of the hanger member 15 forms an apex 23 opposite the bottom portion 16 of the hanger member 15. The apex 23 of the loop portion 21 is designed for inhibiting sliding of the hanger member 15 on the hook stick when the hook stick is positioned in the receiving space 22 of the hanger member 15.

The container member 11 has a plurality of closure members 24. Each of the closure members 24 is positioned adjacent the open top 14 of the container member 11 whereby the closure members 24 are for closing the open top 14 of the container member 11 for restricting access to the interior space 13 of the container member The perimeter wall 12 of the container member 11 has a pair of end walls 25. One of the end walls 25 is positioned opposite the other of the end walls 25 whereby the hanger member 15 is positioned substantially between the end walls 25. Each of the end walls 25 of the container member 11 has a reinforcing rod 26. The reinforcing rod 26 is positioned adjacent an upper edge 27 of the associate one of the end walls 25. The reinforcing rod 26 of each of the end walls 25 is for maintaining a shape of the container member 11 when the container member 11 is suspended in the closet. The reinforcing rod 26 of each of the end walls 25 is designed for distributing weight of the articles in the interior space 13 along a width of the associated one of the end walls 25 for inhibiting the weight from ripping the closure members 24 from the container member 11.

Each of the closure members 24 of the container member 11 has a ring portion 28. The ring portion 28 of each of the closure members 24 is coupled to an associated one of the end walls 25 of the container member 11. The ring portion 28 of each of the closure members 24 defines a hooking space 29 whereby the hooking space 29 of the ring member of each of the closure members 24 is for receiving the hanger member 15 for closing the open top 14 of the container member 11.

The hanger member 15 has a pair of claw portions 30. Each of the claw portions 30 oppositely extends from the bottom portion 16 of the hanger member 15. Each of the claw portions 30 selectively extends through the hooking space 29 of the ring portion 28 of one of the closure members 24 for selectively closing the open top 14 of the container member 11.

Figure 8:
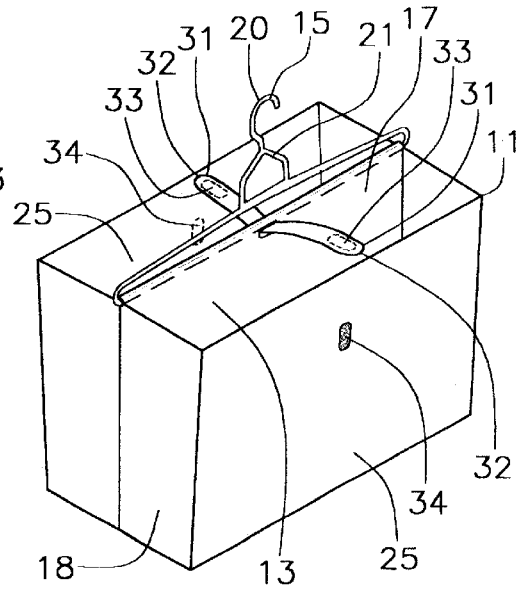
FIG. 8 is a perspective view of an embodiment of the closure members of the present invention.
Figure 6:
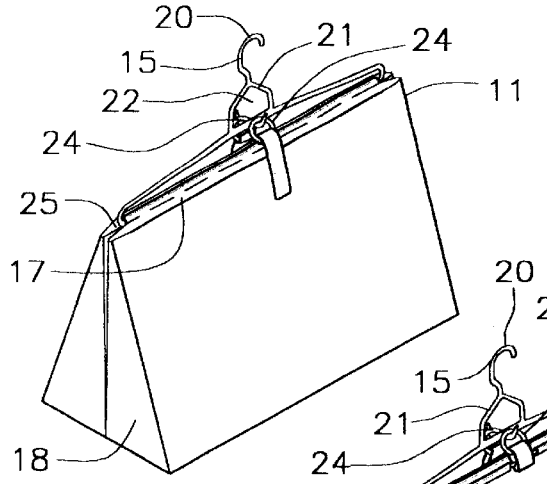
FIG. 6 is a perspective view of an embodiment of the closure members of the present invention.
Figure 9:
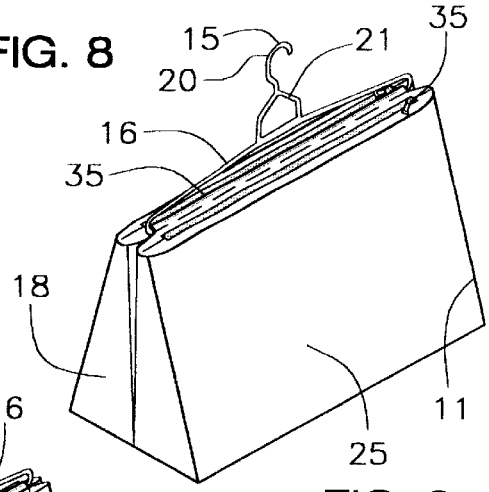
FIG. 9 is a perspective view of an embodiment of the closure members of the present invention.
Figure 7:
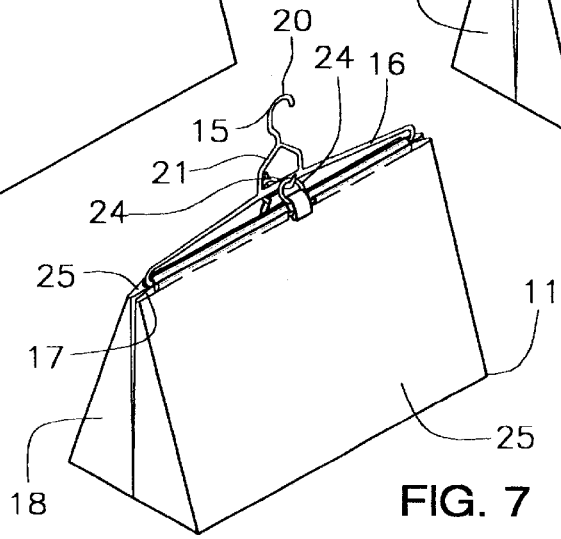
FIG. 7 is a perspective view of an embodiment of the closure members of the present invention.

In an embodiment, as shown in FIG. 8, the closure members 24 may comprise tabs 31 coupled to the dividing wall 17 of the container member 11. A free end 32 of each of the tabs 31 having a first portion of hook and loop fastener 33 that selectively engages a second portion of hook and loop fastener 34 on the associated one of the ends walls for closing the open top 14 of the container member 11. As shown in FIG. 9, a the closure members 24 may comprise a zipper 35 positioned between the associated one of the end walls 25 and the dividing wall 17 such that the zipper 35 may be used to close the open top 14 of the container member 11.

In use, the user places articles within the interior space 13 of the container member 11. The ring portion 28 of each of the closure members 24 is drawn towards the hanger member 15 and the respective one of the claw members is inserted through the hooking space 29 of the ring member of the associated one of the closure members 24. The hooking stick is then inserted into the receiving space 22 of the hanger member 15 and the hanger member 15 and container member 11 are raised on the end of the hooking stick. The hooking stick is used to guide the hook portion 20 of the hanger member 15 over the closet rod so that the closet rod supports the container member 11 and the hanger member 15. The user can the reverse the process to remove the articles from a closet.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A closet storage device for storing articles in a closet, the closet storage device comprising:

a container member having a perimeter wall, said perimeter wall defining an interior space, said container member having an open top such that said open top is adapted for permitting articles to be inserted into said interior space of said container member;

a hanger member having a bottom portion, said bottom portion being coupled to said container member such that said container member is suspended below said hanger member, said hanger member being adapted for selectively engaging a closet rod for suspending said container member in the closet;

said container member having at least one dividing wall, said dividing wall extending between a pair of side walls of said perimeter wall of said container member such that said dividing wall extends between said open top of said container member and a bottom wall of said container member, said dividing wall being positioned in said interior space such that said dividing wall is for dividing said interior space into a plurality of compartments;

said container member having a plurality of closure members, each of said closure members being positioned adjacent said open top of said container member such that said closure members are for closing said open top of said container member for restricting access to said interior space of said container member; and each of said closure members of said container member having a ring portion, said ring portion of each of said closure members being coupled to an associated one of pair of end walls of said container member, said ring portion of each of said closure members defining a hooking space such that said hooking space of said ring member of each of said closure members is for receiving said hanger member for closing said open top of said container member.

2. The closet storage device as set forth in claim 1, wherein said dividing wall is coupled to said bottom portion of said hanger member, said dividing wall being adapted for dispersing weight from said container member and the articles in said interior space of said container member along a portion of a length of said bottom portion of said hanger member.

3. The closet storage device as set forth in claim 1, further comprising:

said hanger member having a hook portion, said hook portion upwardly extending from said bottom portion of said hanger member opposite said container member, said hook portion being adapted for selectively engaging the closet rod of the closet for suspending said container member in the closet when said hook portion of said hanger member engages the closet rod.

4. The closet storage device as set forth in claim 1, further comprising:

said hanger member having a loop portion, said loop portion being coupled to said bottom portion of said hanger member, said loop portion defining a receiving space between said loop portion and said bottom portion of said hanger member such that said receiving space is adapted for receiving an end of a hook stick for disengaging said hanger member from the closet rod.

5. The closet storage device as set forth in claim 4, wherein said loop portion of said hanger member forms an apex opposite said bottom portion of said hanger member, said apex of said loop portion being adapted for inhibiting sliding of said hanger member on the hook stick when the hook stick is positioned in said receiving space of the hanger member.

6. The closet storage device as set forth in claim 1, further comprising:

said perimeter wall of said container member having a pair of end walls, one of said end walls being positioned opposite the other of said end walls such that said hanger member is positioned substantially between said end walls.

7. The closet storage device as set forth in claim 6, further comprising:

each of said end walls of said container member having a reinforcing rod, said reinforcing rod being positioned adjacent an upper edge of the associate one of said end walls, said reinforcing rod of each of said end walls being for maintaining a shape of said container member when said container member is suspended in the closet, said reinforcing rod of each of said end walls being adapted for distributing weight of the articles in said interior space along a width of the associated one of said end walls for inhibiting the weight from ripping said closure members from said container member.

8. The closet storage device as set forth in claim 1, further comprising:

said hanger member having a pair of claw portions, each of said claw portions oppositely extending from said bottom portion of said hanger member, each of said claw portions selectively extending through said hooking space of said ring portion of one of said closure members for selectively closing said open top of said container member.

9. A closet storage device for storing articles in a closet, the closet storage device comprising:

a container member having a perimeter wall, said perimeter wall defining an interior space, said container member having an open top such that said open top is adapted for permitting articles to be inserted into said interior space of said container member;

a hanger member having a bottom portion, said bottom portion being coupled to said container member such that said container member is suspended below said hanger member, said hanger member being adapted for selectively engaging a closet rod for suspending said container member in the closet;

said container member having at least one dividing wall, said dividing wall extending between a pair of side walls of said perimeter wall of said container member, said dividing wall being positioned in said interior space such that said dividing wall is for dividing said interior space into a plurality of compartments;

said dividing wall being coupled to said bottom portion of said hanger member, said dividing wall being adapted for dispersing weight from said container member and the articles in said interior space of said container member along a portion of a length of said bottom portion of said hanger member;

said hanger member having a hook portion, said hook portion upwardly extending from said bottom portion of said hanger member opposite said container member, said hook portion being adapted for selectively engaging the closet rod of the closet for suspending said container member in the closet when said hook portion of said hanger member engages the closet rod;

said hanger member having a loop portion, said loop portion being positioned between said bottom portion and said hook portions of said hanger member, said loop portion defining a receiving space between said loop portion and said bottom portion of said hanger member such that said receiving space is adapted for receiving an end of a hook stick for disengaging said hanger member from the closet rod;

said loop portion of said hanger member forming an apex opposite said bottom portion of said hanger member, said apex of said loop portion being adapted for inhibiting sliding of said hanger member on the hook stick when the hook stick is positioned in said receiving space of the hanger member;

said container member having a plurality of closure members, each of said closure members being positioned adjacent said open top of said container member such that said closure members are for closing said open top of said container member for restricting access to said interior space of said container member;

said perimeter wall of said container member having a pair of end walls, one of said end walls being positioned opposite the other of said end walls such that said hanger member is positioned substantially between said end walls;

each of said end walls of said container member having a reinforcing rod, said reinforcing rod being positioned adjacent an upper edge of the associate one of said end walls, said reinforcing rod of each of said end walls being for maintaining a shape of said container member when said container member is suspended in the closet, said reinforcing rod of each of said end walls being adapted for distributing weight of the articles in said interior space along a width of the associated one of said end walls for inhibiting the weight from ripping said closure members from said container member;

each of said closure members of said container member having a ring portion, said ring portion of each of said closure members being coupled to an associated one of said end walls of said container member, said ring portion of each of said closure members defining a hooking space such that said hooking space of said ring member of each of said closure members is for receiving said hanger member for closing said open top of said container member; and said hanger member having a pair of claw portions, each of said claw portions oppositely extending from said bottom portion of said hanger member, each of said claw portions selectively extending through said hooking space of said ring portion of one of said closure members for selectively closing said open top of said container member.

* * * * *